US009089950B2

(12) United States Patent
Boeck et al.

(10) Patent No.: US 9,089,950 B2
(45) Date of Patent: Jul. 28, 2015

(54) PROTECTIVE HOOD DEVICE

(71) Applicant: Robert Bosch GmbH, Stuttgart (DE)

(72) Inventors: Cornelius Boeck, Kirchheim (DE); Joachim Schadow, Stuttgart (DE); Tobias Overbeck, Moehringen (DE); Rainer Vollmer, Neuhausen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/969,961

(22) Filed: Aug. 19, 2013

(65) Prior Publication Data

US 2014/0057538 A1 Feb. 27, 2014

(30) Foreign Application Priority Data

Aug. 21, 2012 (DE) ..... 10 2012 214 834

(51) Int. Cl.
*B24B 55/05* (2006.01)

(52) U.S. Cl.
CPC ..... *B24B 55/052* (2013.01)

(58) Field of Classification Search
CPC ..... B24B 55/052; B24B 23/00; B24B 23/02
USPC ..... 451/451, 452, 359, 344, 457
See application file for complete search history.

(56) References Cited

U.S. PATENT DOCUMENTS

| | | | | |
|---|---|---|---|---|
| 3,068,620 | A * | 12/1962 | Berne Tocci-Guilbert | 451/451 |
| 5,031,325 | A * | 7/1991 | Walter et al. | 30/390 |
| 7,311,589 | B2 * | 12/2007 | Wiker | 451/451 |
| 7,524,239 | B2 * | 4/2009 | Schmidberger-Brinek et al. | 451/451 |
| 8,221,197 | B2 * | 7/2012 | Boeck et al. | 451/344 |
| 8,460,070 | B2 * | 6/2013 | Boeck et al. | 451/451 |
| 8,465,348 | B2 * | 6/2013 | Boeck et al. | 451/451 |
| 8,500,521 | B2 * | 8/2013 | Boeck et al. | 451/451 |
| 8,550,885 | B2 * | 10/2013 | Tanaka | 451/451 |
| 8,562,395 | B2 * | 10/2013 | Boeck et al. | 451/451 |
| 8,591,293 | B2 * | 11/2013 | Hosokawa et al. | 451/452 |
| 2008/0153404 | A1 * | 6/2008 | Schmidberger-Brinek et al. | 451/359 |
| 2008/0200103 | A1 * | 8/2008 | Esenwein | 451/455 |
| 2009/0023372 | A1 * | 1/2009 | Esenwein | 451/359 |
| 2009/0100885 | A1 * | 4/2009 | Boeck et al. | 70/174 |
| 2009/0266214 | A1 * | 10/2009 | Boeck et al. | 83/478 |
| 2009/0311953 | A1 * | 12/2009 | Maute et al. | 451/359 |
| 2010/0210195 | A1 * | 8/2010 | Numata et al. | 451/451 |
| 2010/0210196 | A1 * | 8/2010 | Hosokawa et al. | 451/452 |

(Continued)

FOREIGN PATENT DOCUMENTS

| | | |
|---|---|---|
| DE | 36 36 500 A1 | 4/1988 |
| EP | 2 428 316 A1 | 3/2012 |

(Continued)

*Primary Examiner* — Joseph J Hail
*Assistant Examiner* — Marc Carlson
(74) *Attorney, Agent, or Firm* — Maginot, Moore & Beck LLP

(57) ABSTRACT

A protective hood device includes at least one basic body, at least one fastening unit, and at least one protective-hood-device anti-rotation unit. The at least one fastening device is configured, at least partially, to fasten the basic body relative to a hand power tool, in particular by force closure. The at least one protective-hood-device anti-rotation unit has at least one stop element, which is configured, at least partially, in at least one operating state of a hand power tool, to lock the basic body against rotation relative to the hand power tool, in particular by form closure. The at least one stop element is at least partially integral with the fastening unit.

9 Claims, 4 Drawing Sheets

(56) References Cited

U.S. PATENT DOCUMENTS

| | | | | |
|---|---|---|---|---|
| 2010/0248599 | A1* | 9/2010 | Voigt et al. | 451/359 |
| 2010/0304648 | A1* | 12/2010 | Boeck et al. | 451/451 |
| 2010/0304649 | A1* | 12/2010 | Sugiura et al. | 451/452 |
| 2012/0034855 | A1* | 2/2012 | Boeck et al. | 451/344 |
| 2012/0052778 | A1* | 3/2012 | Hiller | 451/358 |
| 2012/0108154 | A1* | 5/2012 | Nakamura et al. | 451/451 |
| 2012/0184193 | A1* | 7/2012 | Numata | 451/453 |
| 2012/0190280 | A1* | 7/2012 | Esenwein | 451/452 |
| 2012/0231710 | A1* | 9/2012 | Boeck et al. | 451/451 |
| 2012/0270480 | A1* | 10/2012 | Rohde et al. | 451/451 |
| 2013/0165030 | A1* | 6/2013 | Copeland et al. | 451/451 |
| 2013/0344781 | A1* | 12/2013 | Boeck et al. | 451/451 |
| 2014/0057538 | A1* | 2/2014 | Boeck et al. | 451/359 |

FOREIGN PATENT DOCUMENTS

| | | | | |
|---|---|---|---|---|
| EP | 2276609 | B1 | * | 2/2013 |
| EP | 2214866 | B1 | * | 6/2013 |
| EP | 2607014 | A2 | * | 6/2013 |
| WO | 2012/019342 | A1 | | 2/2012 |

* cited by examiner

PROTECTIVE HOOD DEVICE

This application claims priority under 35 U.S.C. §119 to patent application no. DE 10 2012 214 834.5, filed on Aug. 21, 2012 in Germany, the disclosure of which is incorporated herein by reference in its entirety.

BACKGROUND

There are already known protective hood devices.

SUMMARY

The disclosure is based on a protective hood device having at least one basic body, having at least one fastening unit, which is provided, at least partially, to fasten the basic body relative to a hand power tool, in particular by force closure, and having at least one protective-hood-device anti-rotation unit, which has at least one stop element, which is provided, at least partially, in at least one operating state of a hand power tool, to lock the basic body against rotation relative to the hand power tool, in particular by form closure.

It is proposed that the at least one stop element be realized, at least partially, so as to be integral with the fastening unit. The basic body preferably constitutes a protective hood, which is provided for fastening to a hand power tool, in particular an angle grinder. "By force closure" in this case is to be understood to mean, in particular, a separable fastening, wherein a holding force between two components is transmitted, at least partially, by a frictional force between the components. The protective-hood-device anti-rotation unit is preferably provided to at least limit a movement of the basic body relative to the hand power tool, in particular to a defined maximum angular range. "By form closure" is to be understood to mean, in particular, that surfaces, of components connected to each other by form closure, that bear against each other exert upon each other a holding force that acts in the direction normal to the surfaces. In particular, the components are in a geometric engagement with each other.

"Integral with" is to be understood to mean, in particular, connected at least in a materially bonded manner, for example by a welding process, an adhesive process, an injection process and/or another process considered appropriate by persons skilled in the art, and/or, advantageously, formed in one piece such as, for example, by being produced from a casting and/or by being produced in a single or multi-component injection process and, advantageously, from a single blank. The stop element may be constituted, for example, by a rod element, which, in particular, may have a thread, at least partially.

The configuration according to the disclosure makes it possible to achieve a configuration of the protective hood device that is advantageously simple, inexpensive and, preferably, sparing of components.

Further, it is proposed that the stop element, in at least one operating state of the hand power tool, bear at least partially against a transmission housing of the hand power tool. "Bear against" in this context is to be understood to mean, in particular, that the stop element at least partially contacts the transmission housing of the hand power tool, as a result of which a relative movement of the stop element in relation to the transmission housing can be prevented, at least partially, in at least one stop direction. This makes it possible to achieve a structurally simple, advantageously inexpensive and preferably reliable locking of the basic body against rotation relative to the hand power tool, in particular by form closure.

Furthermore, it is proposed that the stop element be at least partially constituted by a screw element. A "screw element" in this context is to be understood to mean, in particular, an element having at least one thread. A "thread" in this context is to be understood to mean, in particular, a structure comprising at least one profiled notch that, at least partially, extends in a helical curve, in the manner of a continuous spiral around a cylindrical wall. The screw element may have an internal thread and/or an external thread. A preferably robust, inexpensive and reliable configuration of the stop element can thereby be achieved.

Further, it is proposed that the stop element comprise an internal thread, at least partially. An "internal thread" in this context is to be understood to mean, in particular, a thread disposed, at least partially, on an inner circumferential surface of the stop element. An advantageously stable and preferably inexpensive configuration of the receiving element can thereby be achieved.

In addition, it is proposed that the stop element comprise a domed nut, at least partially. An advantageously robust and inexpensive configuration of the stop element can thereby be achieved.

Furthermore, it is proposed that the stop element comprise a threaded bush, at least partially. A "threaded bush" in this context is to be understood to mean, in particular, a hollow-cylindrical component that, at least on an inner circumferential surface, has a thread, at least partially, and that is realized so as to be at least partially open at the ends, in particular as viewed in the direction of main extent. An advantageously robust and inexpensive configuration of the stop element can thereby be achieved.

Further, it is proposed that the protective-hood-device anti-rotation unit comprise at least one cover element, which is provided to cover the threaded bush, at least partially. "Cover" in this context is to be understood to mean, in particular, that at least one part contacts preferably at least one end of the threaded bush that is configured so as to be open, and preferably closes off the same in the axial direction. Advantageously, dust and/or dirt can thereby be prevented from entering the threaded bush.

Furthermore, it is proposed that the fastening unit comprise at least one screw element, which corresponds to the at least one stop element. A "screw element" in this context is to be understood to mean, in particular, an element having a thread, at least partially. A "thread" in this context is to be understood to mean, in particular, a structure comprising at least one profiled notch that, at least partially, extends in a helical curve, in the manner of a continuous spiral around a cylindrical wall. The screw element may have an internal thread and/or an external thread. A preferably robust, inexpensive and reliable configuration of the fastening unit can thereby be achieved.

In addition, it is proposed that the at least one screw element of the fastening unit be screwed into the stop element, at least partially. A preferably reliable connection can thereby be achieved, at least between the stop element and the fastening unit.

Further, it is proposed that the at least one screw element of the fastening unit be connected in a captive manner to the at least one stop element of the protective-hood-device anti-rotation unit. "In a captive manner" in this context is to be understood to mean, in particular, that unintentional separation of the screw element from the stop element is prevented, in particular by a form closure. A preferably user-friendly and reliable configuration of the protective hood device can thereby be achieved in an advantageously simple manner.

BRIEF DESCRIPTION OF THE DRAWINGS

Further advantages are given by the following description of the drawing. The drawing shows several exemplary embodiments of the disclosure. The drawing and the description contain numerous features in combination. Persons skilled in the art will also expediently consider the features individually and combine them to create appropriate further combinations.

In the drawing.

DETAILED DESCRIPTION

Figure 1:
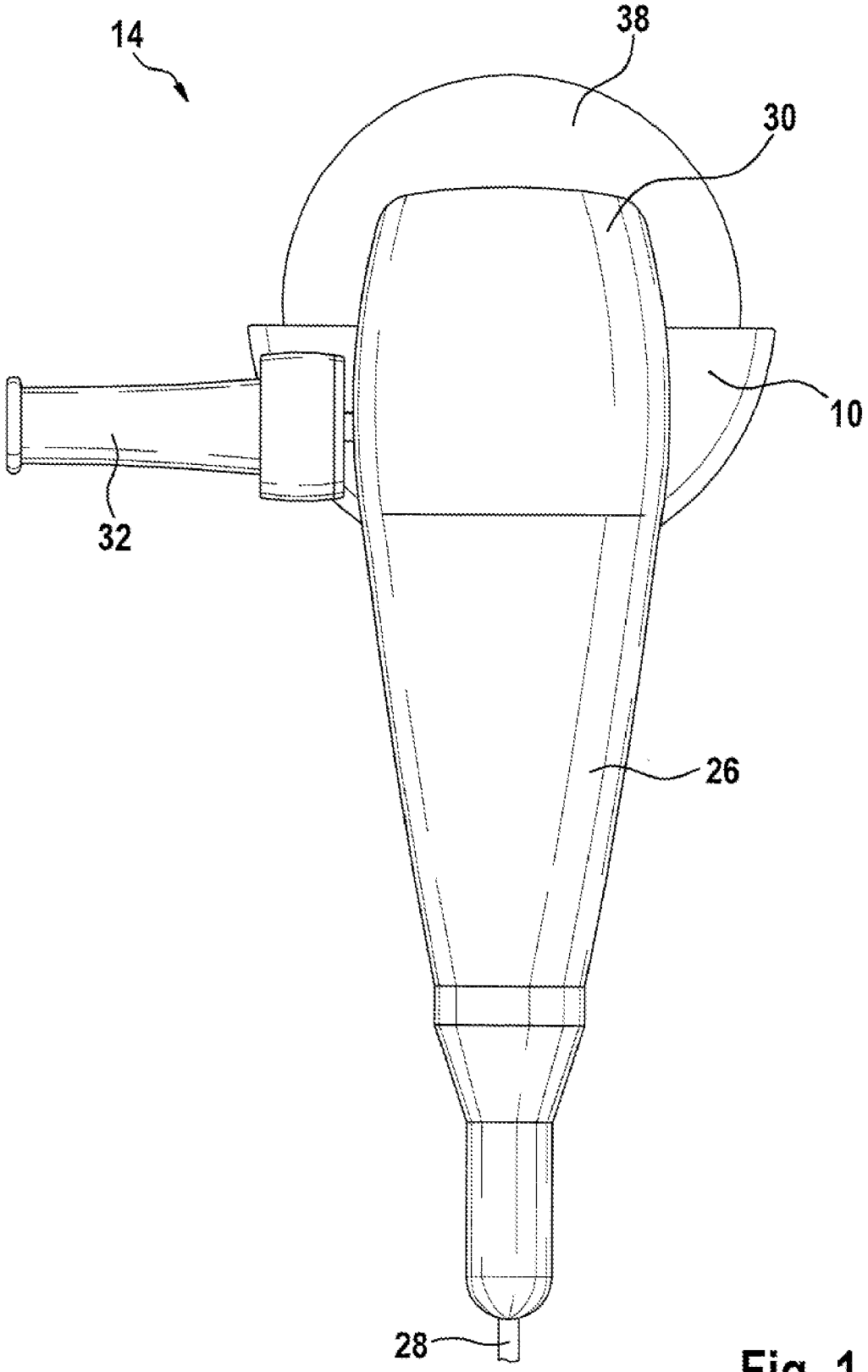
FIG. 1 shows a system comprising a hand power tool and comprising a protective hood device according to the disclosure, in a schematic plan view.

Represented in FIG. 1 is a system comprising a hand power tool 14, constituted by an angle grinder, and a protective hood device. The hand power tool 14 has a housing 26. The housing 26 is cylindrical in form, and serves as a handle for an operator. The housing 26 surrounds a drive unit, not represented, constituted by an electric motor. The housing 26 is composed of a plastic. At one end of the housing 26, the hand power tool 14 has an power cable 28, which is provided to supply the drive unit with electrical energy.

A transmission housing 30 adjoins the end of the housing 26 that faces away from the drive unit. The transmission housing 30 surrounds a transmission unit, not represented. The transmission housing 30 is fixedly connected to the housing 26. The transmission housing 30 is connected to the housing 26 by a screwed connection. The transmission housing 30 is composed of a metal. An ancillary handle 32 is disposed in a region in which the housing 26 and the transmission housing 30 are connected to each other. The ancillary handle 32 extends perpendicularly in relation to an output shaft 34 of the drive unit.

Figure 3A:
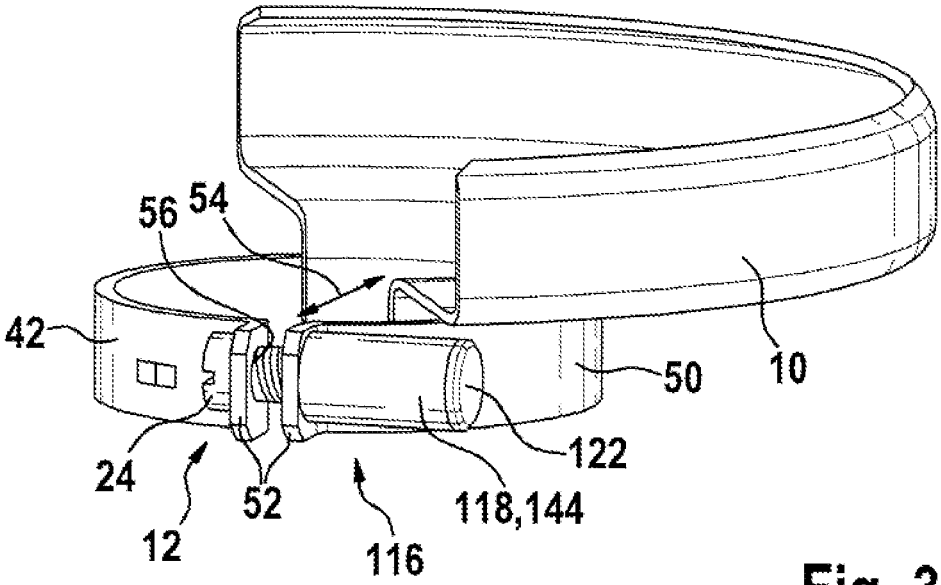
FIG. 3*a* shows an alternatively configured protective hood device, in a perspective representation.
Figure 3B:
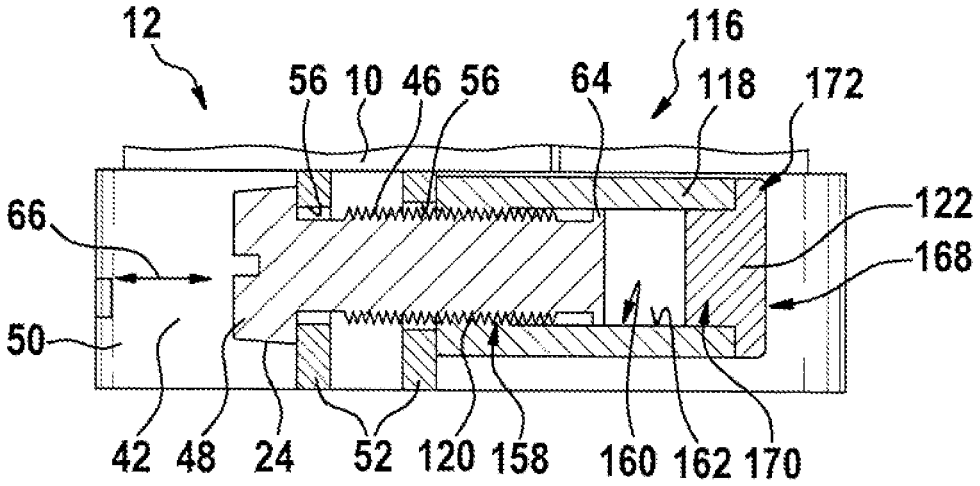
FIG. 3*b* shows a portion of the alternatively configured protective hood device, in a sectional view.
Figure 3C:
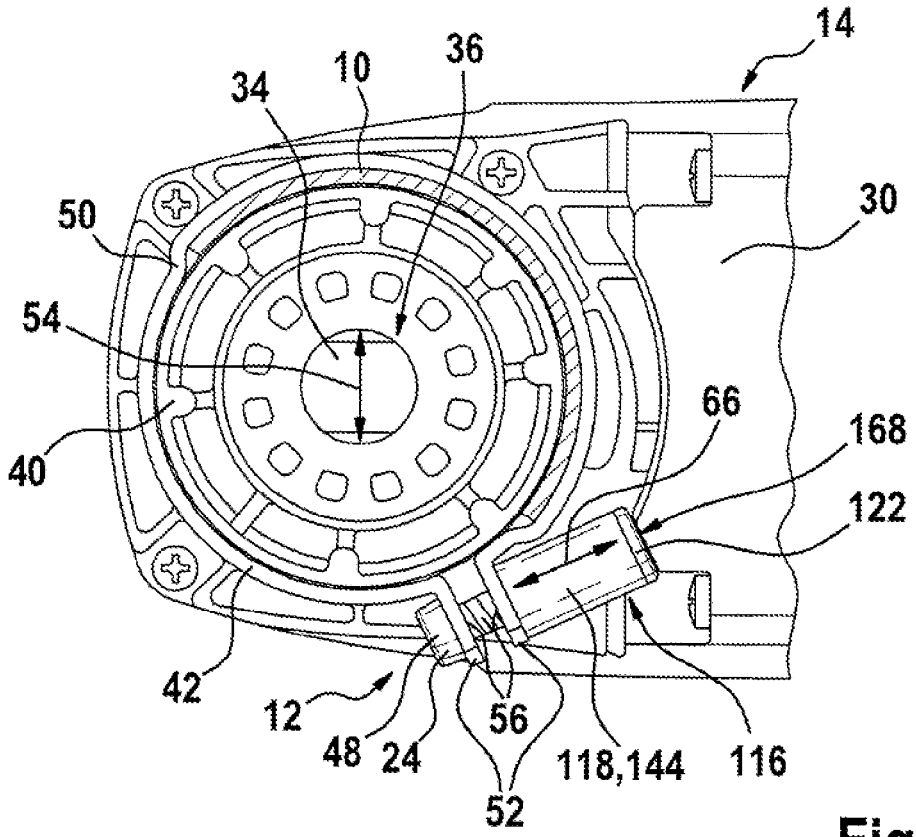
FIG. 3*c* shows the alternatively configured protective hood device having been mounted on the hand power tool, in a sectional view from below.

A tool receiver 36 projects out of the transmission housing 30, perpendicularly in relation to the output shaft 34 of the drive unit and perpendicularly in relation to the ancillary handle 32 (FIG. 3*c*). The tool receiver 36 is provided to receive an insert tool 38 and to drive the same when in an operating state. The insert tool 38 is constituted by a grinding disk or parting disk. The tool receiver 36 is connected to the output shaft 34. The output shaft 34 is surrounded in the circumferential direction by a clamping collar 40. The clamping collar 40 of the hand power tool 14 is provided to receive protective hood device. The protective hood device, when in a mounted state, extends around the tool receiver 36. The clamping collar 40 is disposed between the tool receiver 36 and the transmission housing 30.

Figure 2A:
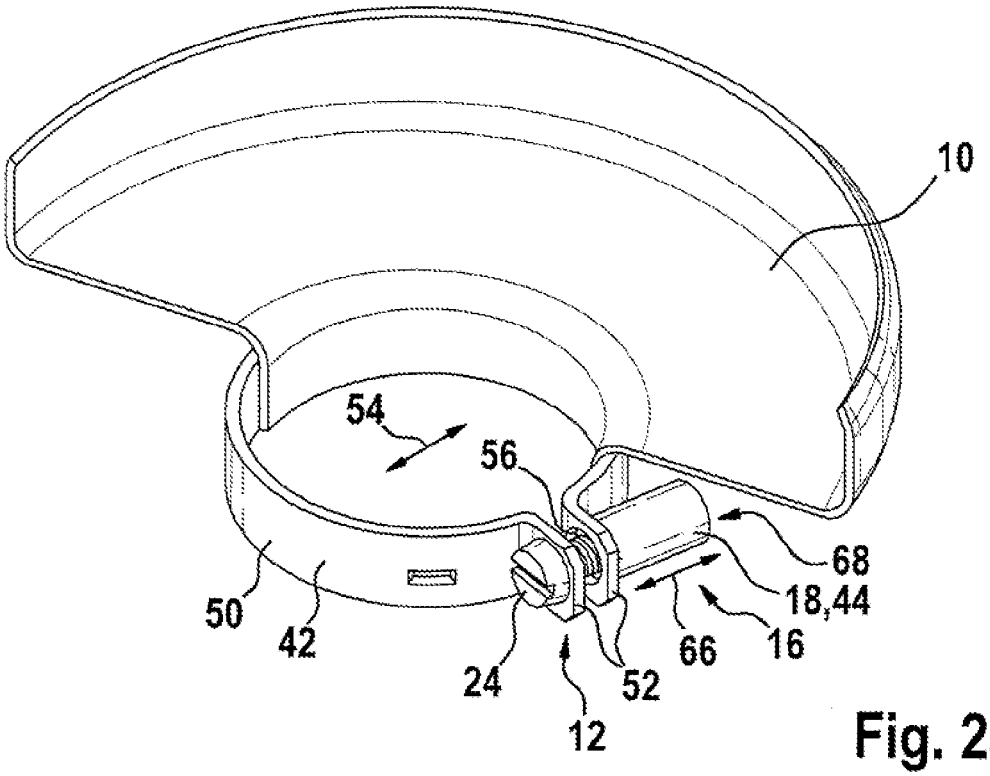
FIG. 2*a* shows the protective hood device according to the disclosure, in a perspective representation.

The protective hood device comprises a basic body 10, which is constituted by a protective hood, and a fastening unit 12 and a protective-hood-device anti-rotation unit 16 (FIG. 2*a*). The fastening unit 12 comprises a fastening element 42 constituted by a clamping strap. The fastening element 42 of the fastening unit 12 is provided to fasten the protective hood device, when in a mounted state, to the clamping collar 40 of the hand power tool 14, by force closure and form closure relative to the hand power tool 14. By means of the fastening element 42, the protective hood device can be steplessly fastened to the clamping collar 40 of the hand power tool 14, in an angular position required by an operator.

The basic body 10 surrounds the insert tool 38, when connected to the tool receiver 36, in an angular range of approximately 180°. The basic body 10 is fixedly connected to the fastening element 42. The basic body 10 is connected to the fastening element 42 in a materially bonded manner. The basic body 10 is welded to the fastening element 42. When in a mounted state, the fastening element 42 bears against the clamping collar 40 of the hand power tool 14 and surrounds the clamping collar.

In order that unwanted rotation of the basic body 10 relative to the tool receiver 36 can be limited, in particular in the case of rupture of the insert tool 38 when in an operating state, the protective-hood-device anti-rotation unit 16 has a stop element 18. The stop element 18 of the protective-hood-device anti-rotation unit 16 is provided to lock the basic body 10 against rotation relative to the hand power tool 14, by form closure, when the hand power tool 14 is in an operating state. The stop element 18 is constituted by a screw element 44. The stop element 18 has an internal thread 20. The stop element 18 is constituted by a threaded bush. The stop element 18 is composed of a metal.

The fastening unit 12 comprises a screw element 24, which is provided to correspond to the stop element 18 of the protective-hood-device anti-rotation unit 16. The screw element 24 has an external thread 46. The screw element 24 is constituted by a screw. The screw element 24 has a screw head 48 having a slotted profile. The screw element 24 of the fastening unit 12 is provided, when in a mounted state, to be screwed into the stop element 18 of the protective-hood-device anti-rotation unit 16. As a result of the screw element 24 of the fastening unit 12 being screwed into the stop element 18 of the protective-hood-device anti-rotation unit 16, the fastening element 42 of the fastening unit 12, when in a mounted state, is clamped around the clamping collar 40 of the hand power tool 14. The fastening unit 12 comprises the stop element 18. The stop element 18 is therefore realized so as to be partially integral with the fastening unit 12.

For this purpose, the fastening element 42 comprises a region 50, which is bent in a circular form and provided for contacting with the clamping collar 40 when in a mounted state. Adjoining the ends of the region 50, respectively, there is a further region 52, which in each case extends parallelwise in relation to a radial direction 54 of the region 50 of the fastening element 42. An opening 56 is made in each of the further regions 52 of the fastening element 42. The openings 56 are disposed serially and in an overlapping manner, as viewed at a tangent to the region 50 of the fastening element 42. When in a mounted state, the screw element 24 of the fastening unit 12 extends through the openings 56 of the fastening element 42. As a result of the screw element 24 being screwed into the stop element 18, the further regions 52 of the fastening element 42 are pressed towards each other in the circumferential direction. A distance between the further regions 52 of the fastening element 42 is thereby reduced. The fastening element 42 undergoes elastic deformation as a result.

Figure 2B:
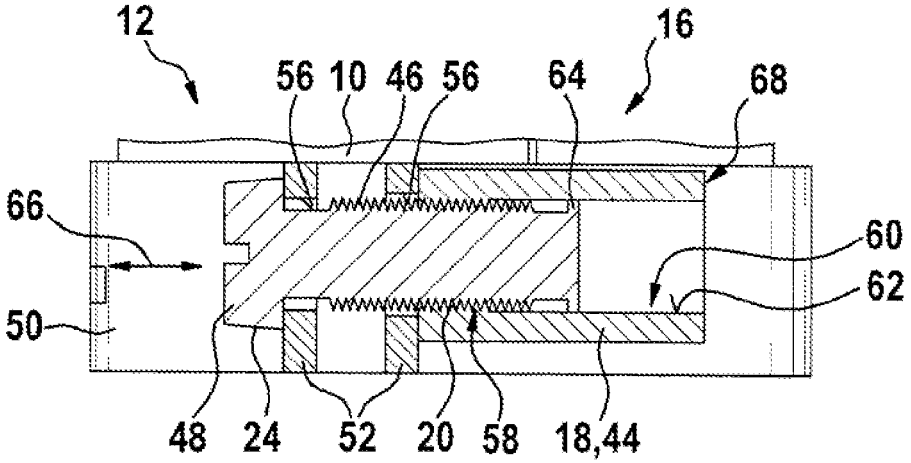
FIG. 2*b* shows a portion of the protective hood device according to the disclosure, in a sectional view.

The stop element 18 is realized in the form of a hollow cylinder (FIG. 2*b*). An inner wall of the stop element 18 has a first region 58 having a first inner diameter, and a further region 60 having a further inner diameter. The further inner diameter is greater than the first inner diameter. The further region 60 of the stop element 18 has a planar inner circumferential surface 62 and an annular cross section. The first region 58 has the internal thread 20 and, likewise, an annular cross section. The external thread 46 of the screw element 24 of the fastening unit 12, when in a mounted state, engages in the internal thread 20 of the stop element 18 of the protective-hood-device anti-rotation unit 16. It is also conceivable for the stop element to be constituted, for example, by an elongated screw nut.

When in a mounted state, an end of the screw element 24 that is opposite the screw head 48 of the screw element 24 is disposed radially inside the stop element 18 and surrounded by the further region 60 of the stop element 18. The end of the screw element 24 has a caulking 64, which is oriented radially outward. The caulking 64 has a greater diameter than the external thread 46 of the screw element 24. The caulking 64 has a greater diameter than the internal thread 20 of the stop element 18. As a result, the screw element 24 of the fastening unit 12 is locked in the axial direction 66 relative to the stop element 18 of the protective-hood-device anti-rotation unit 16. As a result, the screw element 24 of the fastening unit 12 is connected in a captive manner to the stop element 18 of the protective-hood-device anti-rotation unit 16. Alternatively or additionally, it is also conceivable for the screw element 24 to be locked relative to the stop element 18 of the protective-hood-device anti-rotation unit 16 by means of a C-clip, or by another element considered appropriate by persons skilled in the art.

In the event of a rupture of the insert tool 38 when in an operating state, there may be forces acing upon the protective hood device that are greater, in the circumferential direction, than a frictional force between the clamping collar 40 of the hand power tool 14 and the fastening element 42 of the fastening unit 12. In this case, the protective hood device rotates relative to the hand power tool 14, until the stop element 18, which is disposed tangentially in relation to the circumferential direction, contacts the transmission housing 30 of the hand power tool 14. When the hand power tool 14 is in an operating state, the stop element 18 bears against a transmission housing 30 of the hand power tool 14. As a result, a form-closure contact is created between an end of the stop element 18 that faces away from the screw element 24 of the fastening unit 12 and a stop region 68 of the transmission housing 30 of the hand power tool 14, and locking against rotation is therefore achieved.

The descriptions that follow, and the drawing of the further exemplary embodiments, are limited substantially to the differences between the exemplary embodiments and, in principle, reference may also be made to the drawings and/or to the description of the other exemplary embodiments in respect of components denoted in like manner, in particular in respect of components having the same reference numerals. To differentiate the exemplary embodiments, the relevant reference numerals of the further exemplary embodiments are prefixed by the numerals 1 and 2.

Represented in FIGS. 3*a* to 3*c* is an alternatively configured protective hood device, comprising a fastening unit 12, a basic body 10 and a protective-hood-device anti-rotation unit 116. The basic body 10 corresponds to the basic body 10 already described. The fastening unit 12 corresponds to the fastening unit 12 already described. The protective-hood-device anti-rotation unit 116 corresponds to the protective-hood-device anti-rotation unit 16 already described, and additionally has a cover element 122, which is provided to cover in the axial direction 66 a stop element 118 of the protective-hood-device anti-rotation unit 116, which stop element is constituted by a screw element 144 having an internal thread 120. The cover element 122 has a first region 170, which is realized in the form of a disk. Moreover, the cover element 122 has a further region 172, which is likewise realized in the form of a disk. The first region 170 and the further region 172 of the cover element 122 are disposed parallelwise in relation to each other, and adjoin each other. The first region 170 has a lesser diameter than the further region 172. The diameter of the first region 170 of the cover element 122 corresponds to the inner diameter of the further region 160 of the stop element 118. The first region 170 has a greater thickness than the further region 172. The further region 160 of the stop element 118 has a planar, curved inner circumferential surface 162. The stop element 118 has a first region 158, which has the internal thread 120.

The cover element 122 is composed of a plastic. It is also conceivable, however, for the cover element 122 to be composed of a metal, a rubber, an elastomer, a composite material, or of another material, considered appropriate by persons skilled in the art. When in a mounted state, the cover element 122 is inserted, with the first region 170, into an end of the stop element 118 configured so as to be open, and is held there by force closure. The further region 172 covers the end of the stop element 118 when in a mounted state, as viewed in the axial direction 66. The cover element 122 prevents dust from entering the stop element 118 of the protective-hood-device anti-rotation unit 116, and constitutes a stop region 168 that, in the event of rupture of an insert tool 38 of a hand power tool 14, to which the protective hood device is coupled, corresponds to a transmission housing 30 of the hand power tool 14, as already described (FIG. 3*c*). Further, the cover element 122 is provided to protect the transmission housing 30 and/or the stop element 118 against damage in the event of the stop element 118 coming into contact with the transmission housing 30. The cover element 122 is thus realized as a protective and sacrificial element.

Figure 4:
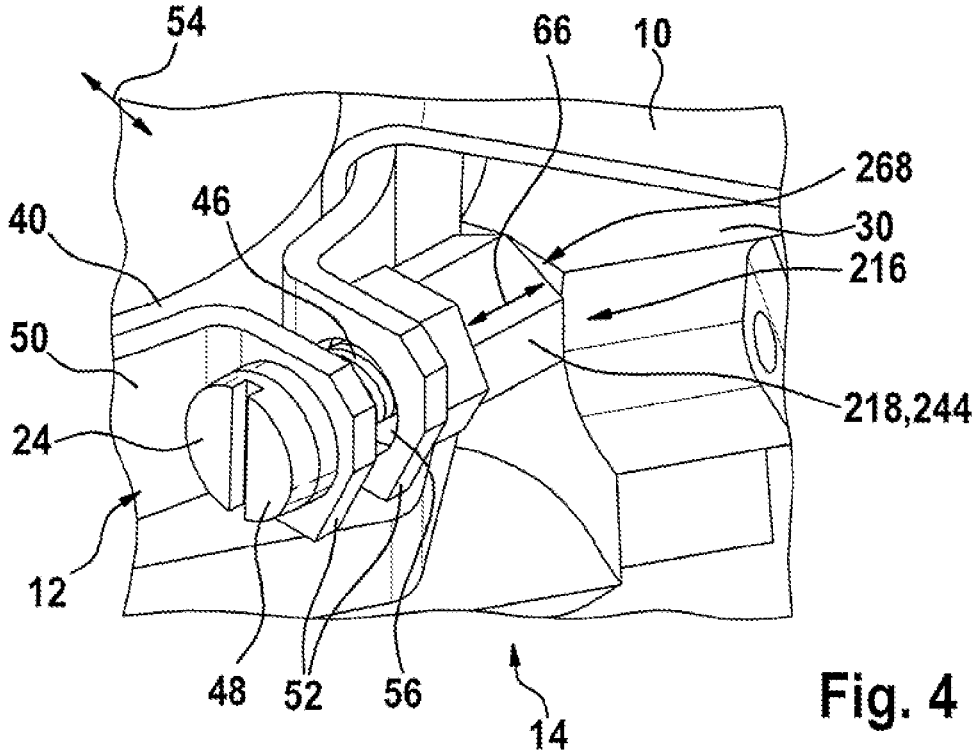
FIG. 4 shows a portion of a further alternatively configured protective hood device, in a sectional view.

Represented in FIG. 4 is an alternatively configured protective hood device, having a fastening unit 12, a basic body 10 and a protective-hood-device anti-rotation unit 216. The basic body 10 corresponds to the basic body 10 already described. The fastening unit 12 corresponds to the fastening unit 12 already described. In respect of functioning, the protective-hood-device anti-rotation unit 216 corresponds to the protective-hood-device anti-rotation unit 16 already described. The protective-hood-device anti-rotation unit 216 comprises a stop element 218, which is constituted by a screw element 244. The stop element 218 has an annular cross section having a hexagonal outer contour and having a round inner contour of an inner circumferential surface 262. The stop element 218, as viewed in the axial direction 66, is realized so as to be closed at an end opposite an internal thread 220. The end of the stop element 218 that is realized so as to be closed constitutes a stop region 268. The stop element 218 is composed of a metal. It is also conceivable, however, for the stop element 218 to be composed of a plastic, a rubber, an elastomer, a composite material, or of another material, considered appropriate by persons skilled in the art. The stop element 218 is constituted by a domed nut.

What is claimed is:

1. A protective hood device, comprising:

at least one basic body, at least one fastening unit configured, at least partially, to fasten the at least one basic body relative to a hand power tool, the fastening unit including:

a first end;

a second end; and a screw element that has an external thread and that is configured to fasten the first end to the second end to enable the at least one fastening unit to at least partially fasten the at least one basic body relative to a hand power tool; and at least one protective-hood-device anti-rotation unit including at least one stop element that is integrally formed with the second end of the fastening unit, and that has:

a substantially cylindrical interior region having an internal thread configured to receive the external thread of the screw element; and a further region extending beyond the interior region in an axial direction such that when the screw element is received in the internal thread, the further region extends beyond the screw element in the axial direction;

the at least one stop element being configured, at least partially, in at least one operating state of the hand power tool, to lock the at least one basic body against rotation relative to the hand power tool, and the further region of the stop element being configured to bear against a transmission housing of the hand power tool when the at least one stop element is in the at least one operating state of the hand power tool.

2. The protective hood device according to claim 1, wherein the at least one stop element includes a domed nut, at least partially.

3. The protective hood device according to claim 1, wherein the at least one stop element includes a threaded bush, at least partially.

4. The protective hood device according to claim 1, wherein the at least one protective-hood-device anti-rotation unit includes at least one cover element configured to cover the at least one stop element, at least partially.

5. The protective hood device according to claim 1, wherein the at least one screw element of the at least one fastening unit is connected in a captive manner to the at least one stop element of the at least one protective-hood-device anti-rotation unit.

6. The protective hood device according to claim 1, wherein the at least one fastening unit is configured to fasten the at least one basic body relative to the hand power tool by force closure.

7. The protective hood device according to claim 1, wherein the at least one stop element is configured to lock the at least one basic body against rotation relative to the hand power tool by form closure.

8. A system, comprising:

at least one hand power tool that includes a stop surface; and at least one protective hood device, including:

at least one basic body, at least one fastening unit that includes a first end that has a fastening element, and a second end having an interior configured to receive at least a portion of the fastening element, wherein the fastening element is configured, at least partially, to tighten the first end against the second end in order to fasten the at least one basic body relative to the at least one hand power tool, and at least one protective-hood-device anti-rotation unit, having:

at least one stop element integrally formed with the second end of the at least one fastening unit; and a cover element, separate and apart from the fastening element, that is arranged on an end of the at least one stop element which faces away from the first end of the fastening unit, that closes off the interior of the at least one stop element and that defines a stop face configured and arranged to bear against the stop surface of the hand power tool, and being configured, at least partially, in at least one operating state of the at least one hand power tool, to lock the at least one basic body against rotation relative to the at least one hand power tool.

9. A protective hood device, comprising:

at least one basic body, at least one fastening unit configured, at least partially, to fasten the at least one basic body relative to a hand power tool, the fastening body including:

a first end;

a second end; and a screw element that has:

a screw head;

an external thread and that is configured fasten the first end to the second end to enable the at least one fastening unit to at least partially fasten the at least one basic body relative to a hand power tool; and a caulking element that has a diameter that is larger than a diameter of the external thread, and that is on an end of the screw that is opposite the screw head; and at least one protective-hood-device anti-rotation unit including at least one stop element that is integrally formed with the second end of the fastening body, and that has:

an internal thread configured to receive the external thread of the screw element such that the caulking element is received within the stop element, extends beyond the internal thread, and holds the screw element captive within the stop element;

the at least one stop element being configured, at least partially, in at least one operating state of the hand power tool, to lock the at least one basic body against rotation relative to the hand power tool.

* * * * *